US005180323A

United States Patent [19]

Justice

[11] Patent Number: 5,180,323

[45] Date of Patent: Jan. 19, 1993

[54] INTERLOCKING TOY COMPONENTS

[75] Inventor: Kyle A. Justice, Lake City, Tenn.

[73] Assignee: Ultimate Manufacturing, Lake City, Tenn.

[21] Appl. No.: 783,887

[22] Filed: Oct. 29, 1991

[51] Int. Cl.[5] ..... A63H 33/06; A63H 33/08

[52] U.S. Cl. ..... 446/120; 446/125; 446/105

[58] Field of Search ..... 446/120, 121, 122, 125, 446/116, 105, 124, 126

[56] References Cited

U.S. PATENT DOCUMENTS

| | | | |
|---|---|---|---|
| 2,649,803 | 8/1953 | Andre | 446/120 X |
| 2,662,335 | 12/1953 | Calverly | 446/120 X |
| 2,885,822 | 5/1959 | Onanian | 446/122 X |
| 4,035,978 | 7/1977 | Connelly | 446/116 X |
| 5,000,713 | 3/1991 | Cheng | 446/120 |

FOREIGN PATENT DOCUMENTS

| | | | |
|---|---|---|---|
| 520969 | 1/1956 | Canada | 446/125 |
| 2434365 | 1/1976 | Fed. Rep. of Germany | 446/122 |
| 1376301 | 12/1974 | United Kingdom | 446/125 |

*Primary Examiner*—David N. Muir
*Attorney, Agent, or Firm*—Pitts & Brittian

[57] ABSTRACT

Interlocking toy components for the construction of structures defining various geometric configurations. The toy components of the present invention include a first component (10) having an elongated trunk portion (14). The first component (10) carries a protruding member (20) extending from the first end portion (16) of the trunk portion (14), and the trunk portion (14) is provided at its second end portion (18) with a substantially coaxial first receptor (22) for releasably receiving the protruding members (20) of other first components (10). The trunk portion (14) of the first component is also provided proximate its second end portion with a plurality of further receptors (24) radially spaced about the trunk portion (14) for releasably receiving the protruding members (20) of other first components (10). The invention also includes a second component (12) having an elongated trunk portion (34). The second component (12) includes a protruding member (40) extending from the first end portion (36) of the trunk portion (34) for being releasably received in the receptor (22) or further receptors (24) of a first component (10), and includes a further protruding member (42) extending from the second end portion (38) of the trunk portion (34) for being releasably received in the receptor (22) or further receptors (24) or a first component (10).

6 Claims, 3 Drawing Sheets

INTERLOCKING TOY COMPONENTS

TECHNICAL FIELD

This invention relates to interlocking toy components for being selectively assembled into structures defining various configurations. In this particular invention the toy components include a first component for releasably interlocking with one or more second components and/or one or more other similarly configured first components.

BACKGROUND ART

Toy building blocks and similar toy construction components are well known in the art, and certain of such blocks or components are provided with means for releasably interlocking the blocks or components in order to hold the structures assembled therefrom together. However, generally the structures assembled from such blocks or components are unstable and fall apart if manipulated. As a result, the assembled structure cannot be played with without the risk of the components inadvertently coming apart. Also, with conventional toy construction components assembly of a desired structure is often frustrated by the interlocking components coming apart before the structure is completed. In an effort to solve these problems, toy construction components have been developed which feature locking means which securely lock the components together. However, such locking means generally make both assembly and disassembly of the components difficult and tedious.

Therefore, it is an object of the present invention to provide interlocking toy construction components which are easily assembled and disassembled, yet can be assembled into a structure which is sturdy and not prone to inadvertent disassembly.

It is another object of the present invention to provide interlocking toy construction components which can be used to construct structures defining various geometric configurations.

Yet another object of the present invention is to provide interlocking toy construction components which can be readily assembled and disassembled by a child.

Still another object of the present invention is to provide interlocking toy construction components which are durable, yet inexpensive to manufacture.

DISCLOSURE OF THE INVENTION

Other objects and advantages will be accomplished by the present invention which provides interlocking toy components for the releasable construction of structures defining various geometric configurations. The toy components of the present invention include a first component having an elongated body defining a trunk portion. The trunk portion of the first component carries a protruding member extending outwardly from its first end portion, and is provided at its second end portion with a substantially coaxial first receptor for releasably receiving the protruding members of other first components. The trunk portion of the first component is also provided proximate its second end portion with a plurality of further receptors radially spaced about the trunk portion for releasably receiving the protruding members of other first components. The invention also includes a second component having a body defining a elongated trunk portion. The trunk portion of the second component carries a protruding member extending outwardly from the its first end portion for being releasably and selectively received in the first receptor or further receptors of a first component, and carries a further protruding member extending from its second end portion for being releasably and selectively received in the first receptor or further receptors of a first component.

BRIEF DESCRIPTION OF THE DRAWINGS

The above mentioned features of the invention will be more clearly understood from the following detailed description of the invention read together with the drawings in which.

BEST MODE FOR CARRYING OUT THE INVENTION

Figure 1:
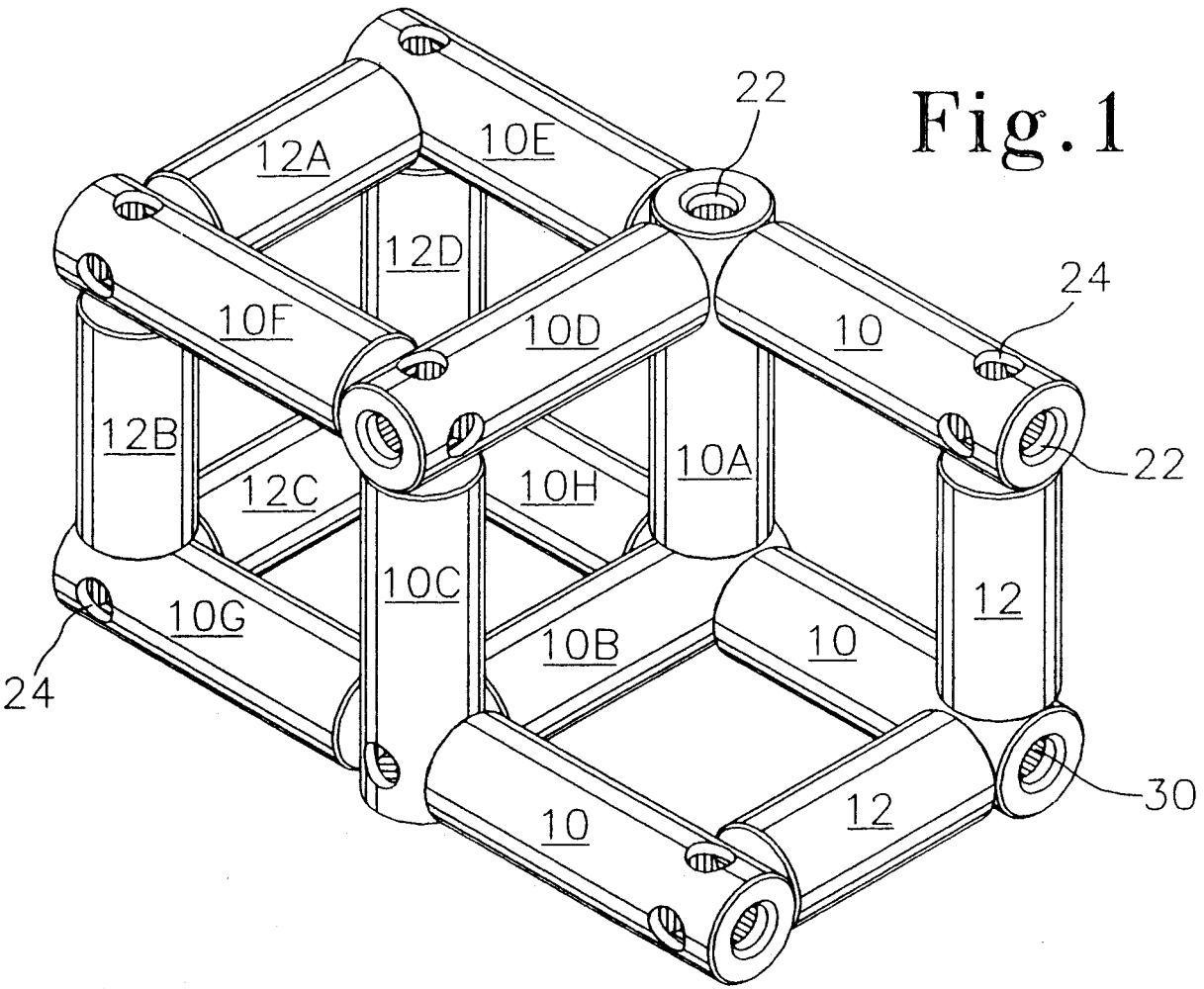
FIG. 1 illustrates a perspective view of interlocking components of the present invention.
Figure 3:
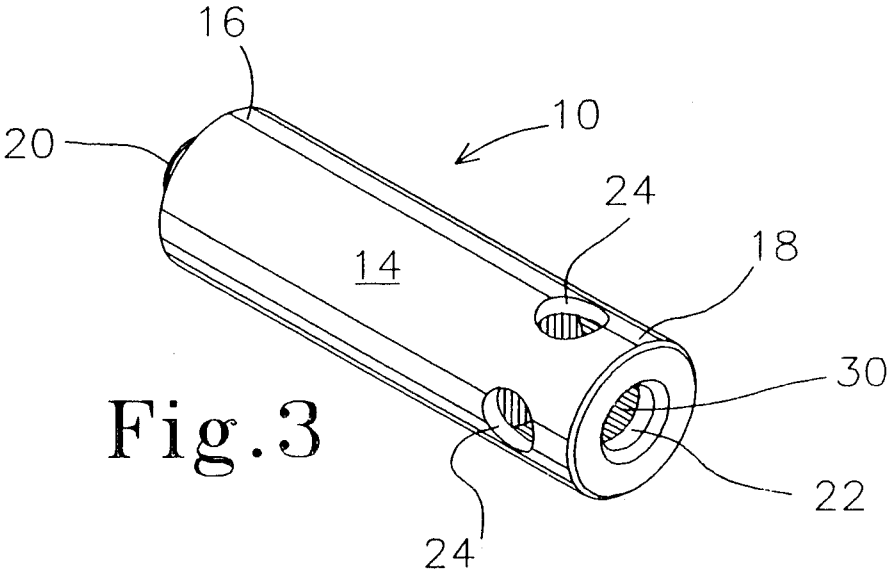
FIG. 3 illustrates a perspective view of a first interlocking component of the present invention.
Figure 4:
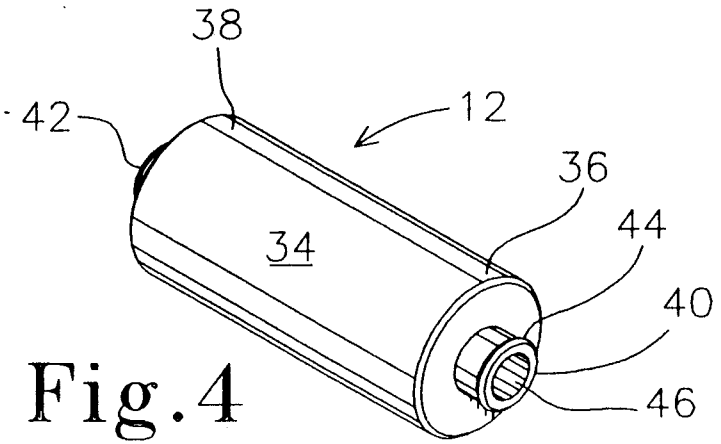
FIG. 4 illustrates a perspective view of a second interlocking component of the present invention.
Figure 2:
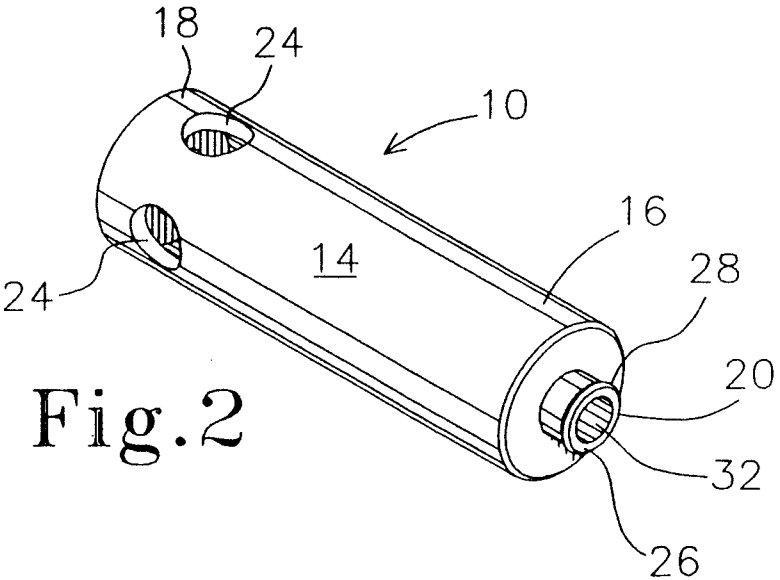
FIG. 2 illustrates a perspective view of a first interlocking component of the present invention.

Interlocking toy components incorporating various features of the present invention are illustrated generally at 10 and 12 in the Figures. In this regard, the present invention includes a first interlocking component 10 and a second interlocking component 12. The first interlocking component 10 is designed to releasably interlock with one or more other first interlocking components 10, and/or one or more second interlocking components 12, to permit the construction of structures defining various geometric configurations.

More specifically, in the preferred embodiment the first interlocking component 10 includes an elongated body defining a trunk portion 14 having first and second end portions 16 and 18, respectively. The trunk portion 14 is provided with a substantially coaxial protruding member 20 which is disposed on, and extends outwardly from, the first end portion 16 of the trunk portion 14. The trunk portion 14 is also provided with a first receptor 22 which is substantially coaxially disposed in the second end portion 18, and is provided with a plurality of further receptors 24 radially spaced about the trunk portion 14 proximate the second end portion 18.

As will be discussed further below, the receptors 22 and 24 are configured to closely receive the protruding members 20 of other components 10, and, in the preferred embodiment, the protruding member 20 is designed to snap-fit into the receptors 22 and 24. In this regard, the component 10 is preferably fabricated of a resilient plastic, and the protruding member 20 defines an outboard end 26/having a protruding rim 28 circumscribing its exterior. The rim 28 defines an outer perimeter or circumference which is greater than the perimeter or circumference of the receptors 22 and 24 so as to provide for the force-fit reception of the protruding member 20 in a receptor 22 or 24.

Further, the second end portion 18 of the trunk portion 14 defines an internal cavity 30 into which the receptors 22 and 24 open, and the length of the protruding member 20 is such that, as the protruding member 20 of another component 10 is received in a receptor 22 or 24, the outboard end 26 carrying the rim 28 is received in the cavity 30. As a result, a snap-fit reception of the protruding member 20 in the receptors 22 and 24 is provided. It will also be noted that in the preferred embodiment the protruding member 20 defines a substantially coaxial hole 32 which enhances the flexibility of the protruding member 20 to insure that the snap-fit coupling is readily releasable.

The second interlocking component 12 includes an elongated body defining a trunk portion 34 having first and second end portions 36 and 38, respectively. The trunk portion 34 carries a pair of oppositely disposed, substantially coaxial protruding members 40 and 42 which extend outwardly from the first and second end portions 36 and 38, respectively. The protruding members 40 and 42 are configured to be closely and releasably received in the receptors 22 and 24 of a component 10 to effect the releasable coupling of the component 12 and such component 10.

In the preferred embodiment, the second component 12 is fabricated of a resilient plastic, and the protruding members 40 and 42 are configured as described above with respect to the protruding member 20 of the component 10. In this regard, the protruding members 40 and 42 are circumscribed by a protruding rim 44 to provide for the snap-fit reception of the protruding members 40 and 42 in the receptors 22 and 24. Further, in the preferred embodiment the protruding members 40 and 42 are provided with the holes 46 to facilitate the releasability of the snap-fit coupling of the components 10 and components 12.

It will be noted that the trunk portions 14 and 34 of the components 10 and 12, and the associated protruding members 20, 40 and 42, are preferably cylindrically shaped as illustrated in FIGS. 1–5. However, the cross sectional configuration of the trunk portions 14 and 34, and the protruding members 20, 40 and 42 can vary. For example, alternate embodiments of the components of the present invention are illustrated at 10' and 12' in FIGS. 6–9. In the illustrated embodiments of FIGS. 6–9 the trunk portions 14' and 34', and the protruding members 20', 40' and 42', define an octagonal cross section.

As best illustrated in FIG. 1, a plurality of first components 10 and second components 12 can be selectively assembled to create various structures. For example, in FIG. 1 the first components 10A–10H and second components 12A–12D have been assembled to form a cube-shaped structure. As a result of the manner in which the components 10 and 12 interlock, the resulting cube-shaped structure provides a stable basic structure from which other, more complex structures can be constructed.

Figure 5:
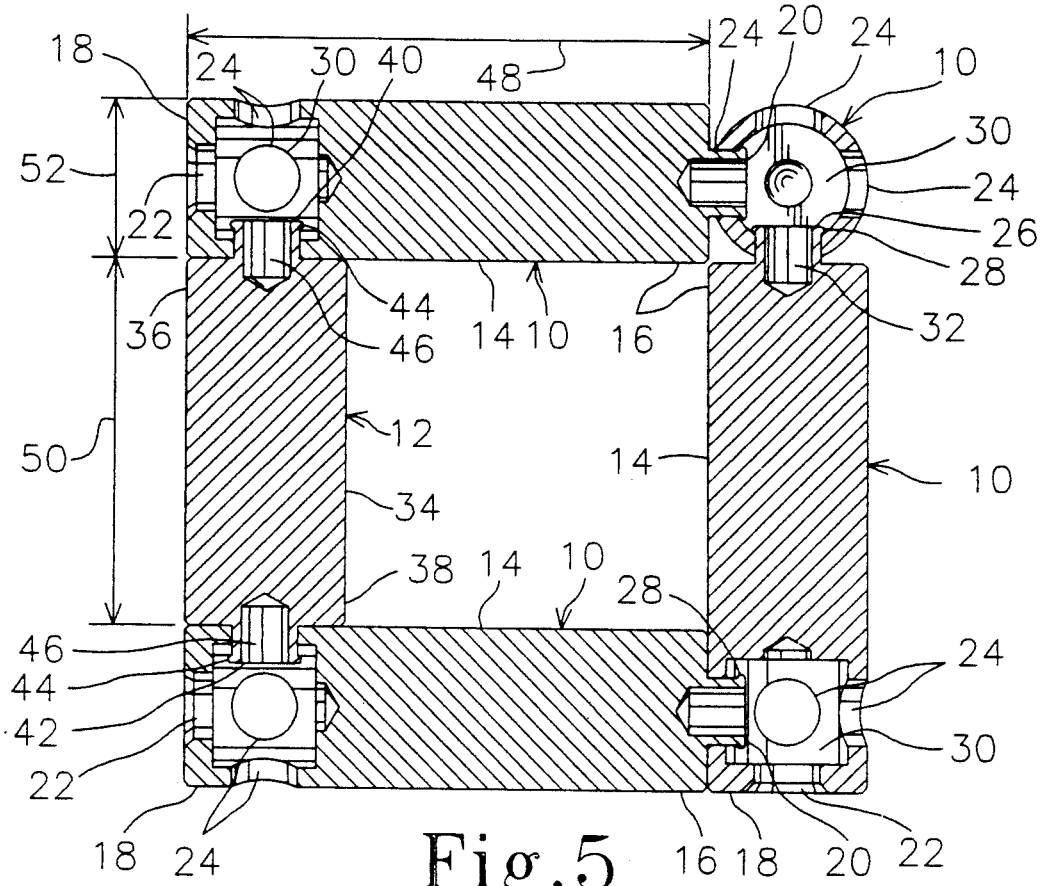
FIG. 5 illustrates a side elevation view, in section, of a plurality of interlocking components of the present invention as such components engage one another.
Figure 7:
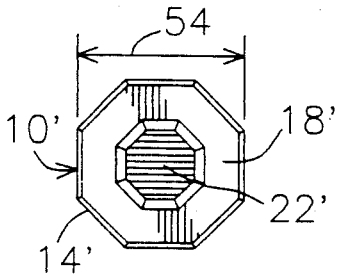
FIG. 7 illustrates an end view of an alternate embodiment of a first interlocking component of the present invention.
Figure 6:
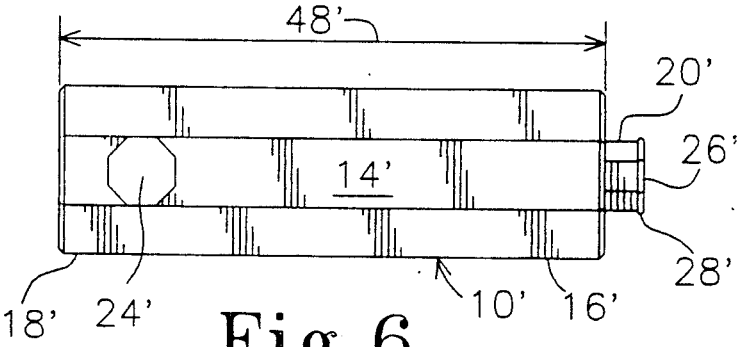
FIG. 6 illustrates a side elevation view of an alternate embodiment of a first interlocking component of the present invention.
Figure 9:
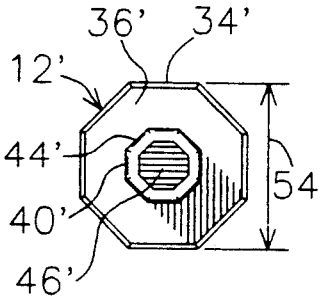
FIG. 9 illustrates an end view of an alternate embodiment of a second interlocking component of the present invention.
Figure 8:
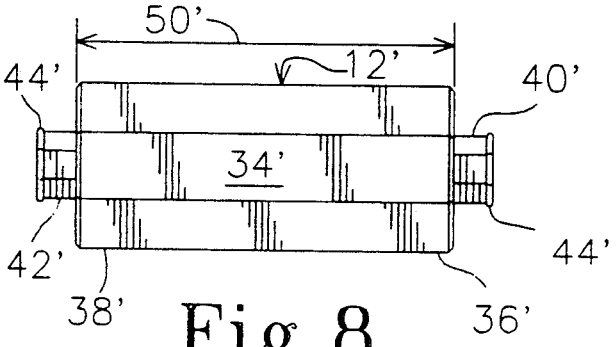
FIG. 8 illustrates a side elevation view of an alternate embodiment of a second interlocking component of the present invention.

In order to facilitate the construction of the desirable cube-shaped substructure illustrated in FIG. 1, in the preferred embodiment the component 10 is provided with four equally spaced receptors 24, with opposing receptors being aligned on a common axis, perpendicular to the longitudinal axis of the trunk portion 14 and perpendicular to the axis shared by the adjacent receptors 24. Also, the length of the trunk portion 14, referenced at 48 in FIG. 5, is substantially equal to the length 50 of the trunk portion 34 of the second component 12, plus the diameter 52 of the component 10 or 12, the diameter of the components 10 and 12 being the same. Of course, where the cross sectional configuration of the components 10 and 12 is something other than circular, as illustrated in FIGS. 6–9, the length 48' of the trunk portion 12' will preferably be equal to the length 50' of the trunk portion 34', plus the width 54 of the components 10' or 12'.

In light of the above it will be recognized that the present invention provides interlocking toy components having great advantages over the prior art. By utilizing a plurality of components 10 and 12 various geometric configurations and/or structures can be produced. The manner in which the components interlock permits easy assembly, and insures that the resulting structures are stable, yet capable of being easily disassembled.

While a preferred embodiment has been shown and described, it will be understood that there is no intent to limit the invention to such disclosure, but rather it is intended to cover all modifications and alternate constructions falling within the spirit and scope of the invention as defined in the appended claims.

I claim:

1. Interlocking toy components for the releasable construction of structures defining various geometric configurations, said components comprising:

a first component defining an elongated trunk portion having first and second end portions, and defining a longitudinal axis, said first component including a protruding member coaxial with said longitudinal axis and extending outwardly from said first end portion of said trunk portion in substantially coaxial alignment, said trunk portion of said first component being provided at said second end portion with a substantially coaxial first receptor defining a selected perimeter for releasably receiving said protruding members of other said first components, said trunk portion of said first component also being provided proximate its second end portion with a plurality of further receptors radially spaced about said trunk portion for releasably receiving said protruding members of other said first components, each of said further receptors defining a selected perimeter substantially similar to said selected perimeter defined by said first receptor, said longitudinal axis of said first component and said longitudinal axis of another said first component being substantially fixed in relation to each other when said protruding member of said first component is selectively received in any of said first receptor and said further receptors of said other first component, said protruding member defining an outboard end portion provided with a circumscribing rim defining an outer perimeter which is greater than said perimeters of said receptor and said further receptors so as to provide for forcefit reception of said protruding member into said first receptor and said further receptors; and a second component defining an elongated trunk portion having first and second end portions, and defining a longitudinal axis, said second component including a second component protruding member mounted upon said front end thereby defining a longitudinal axis and extending outwardly from said first end portion of said trunk portion of said second component in substantially coaxial alignment therewith for being releasably and selectively received in said first receptor and said further receptors of one said first component, said longitudinal axis of said first component and said longitudinal axis of said protruding member being substantially fixed in relation to each other when said second component protruding member is selectively received in any of said first receptor and said further receptors, and said second component including a further protruding member mounted upon said second end along said longitudinal axis and extending outwardly from said second end portion of said trunk portion of said second component in substantially coaxial alignment therewith for being releasably and selectively received in said first receptor and said further receptors of one said first component, said longitudinal axis of said first component and said longitudinal axis of said further protruding member being substantially fixed in relation to each other when said further protruding member is selectively received in any of said first receptor and said further receptors, said protruding member and said further protruding member each defining an outboard end portion provided with a circumscribing rim defining an outer perimeter which is greater than said perimeters of said receptor and said further receptors of said first component so as to provide for force-fit reception of said protruding member and said further protruding member into said first receptor and said further receptors wherein all said receptors are placed to allow each of said first components to receive a plurality of other said first or second components in an orthogonal orientation and a longitudinal orientation simultaneously.

2. The interlocking toy components of claim 1 wherein said second end portion of said trunk portion of said first component is provided with a cavity into which said first receptor and said further receptors open, whereby said outboard end portions of said protruding members and said further protruding member of other said first and second components are received in said cavity as said protruding members and said further protruding members are received in said first receptor and said further receptors such that said circumscribing rims or other said first and second components releasably hold said protruding members and said further protruding members of other said first and second components in said first receptor and said further receptors.

3. The interlocking toy components of claim 1 wherein said trunk portion of said first component defines a cylindrical configuration having a selected diameter, and said trunk portion of said second component defines a cylindrical configuration defining a selected diameter substantially equal to the diameter of said trunk portion of said first component.

4. The interlocking toy components of claim 3 wherein said first component is provided with at least four said further receptors, said further receptors being equally spaced about said second end portion of said trunk portion of said first component.

5. The interlocking toy components of claim 3 wherein the length of said trunk portion of said first component is substantially equal to the length of said trunk portion of said second component, plus said diameter of said trunk portion of said first component.

6. Interlocking toy components for the releasable construction of structures defining various geometric configurations, said components comprising:

a first component including an elongated cylindrical trunk portion having first and second end portions, and defining a selected diameter and a longitudinal axis, said first component including a protruding member along said longitudinal axis and extending outwardly from said first end portion of said trunk portion in substantially coaxial alignment, said trunk portion of said first component being provided at said second end portion with a substantially coaxial first receptor defining a selected perimeter for releasably receiving said protruding members of other said first components, said trunk portion of said first component also being provided proximate said second end portion with four further receptors radially disposed and equally spaced about said trunk portion of said first component for releasably receiving said protruding members of other said first components, each of said further receptors defining a selected perimeter substantially similar to said selected perimeter defined by said first receptor, said longitudinal axis of said first component and said longitudinal axis of another said first component being substantially fixed in relation to each other when said protruding member of said first component is selectively received in any of said first receptor and said further receptors of said other first component, said protruding member defining an outboard end portion provided with a circumscribing rim defining an outer perimeter which is greater than said perimeters of said receptor and said further receptors so as to provide for force-fit reception of said protruding member into said first receptor and said further receptors; and a second component including an elongated cylindrical trunk portion having first and second end portions and defining a longitudinal axis and a diameter substantially equal to said diameter of said trunk portion of said first component, said second component including a protruding member along said longitudinal axis and extending outwardly from said first end portion of said trunk portion of said second component in substantially coaxial alignment therewith for being releasably and selectively received in said first receptor and said further receptors of one of said first component, said longitudinal axis of said first embodiment and said longitudinal axis of said protruding member being substantially fixed in relation to each other when said further protruding member is selectively received in any of said first receptor and said further receptors, and said second component including a further protruding member along said longitudinal axis and extending from said second end portion of said trunk portion of said second component in substantially coaxial alignment therewith for being releasably and selectively received in said first receptor and said further receptors of one said first component, said longitudinal axis of said first component and said longitudinal axis of said further protruding member being substantially fixed in relation to each other when said further protruding member is selectively received in any of said first receptor and said further receptors, said protruding member and said further protruding member each defining an outboard end portion provided with a circumscribing rim defining an outer perimeter which is greater than said perimeters of said receptor and said further receptors of said first component so as to provide for force-fit reception of said protruding member and said further protruding member into said first receptor and said further receptors wherein all said receptors are placed to allow each of said first components to receive a plurality of other said first or second components in an orthogonal orientation and a longitudinal orientation simultaneously.

* * * * *